US006774798B2

(12) United States Patent
Fordyce et al.

(10) Patent No.: US 6,774,798 B2
(45) Date of Patent: Aug. 10, 2004

(54) PERSONAL ALARM SYSTEM

(76) Inventors: Robert J. Fordyce, Box 634 RR 1, Dugald, Manitoba (CA), R0E 0K0; Mark L. Yukelis, 3 Envoy Cres, Winnipeg, Manitoba (CA), R0V 3K5

( * ) Notice: Subject to any disclaimer, the term of this patent is extended or adjusted under 35 U.S.C. 154(b) by 46 days.

(21) Appl. No.: 10/246,573

(22) Filed: Sep. 17, 2002

(65) Prior Publication Data

US 2004/0051641 A1 Mar. 18, 2004

(51) Int. Cl.[7] ..... G08B 23/00
(52) U.S. Cl. ..... 340/573.1; 340/384.4; 340/540; 116/83; 116/77
(58) Field of Search ..... 340/573.1, 574, 340/532, 384.4, 540; 116/83, 84, 77; 367/198

(56) References Cited

U.S. PATENT DOCUMENTS 5,289,164 A * 2/1994 Novak ..... 340/574
6,130,616 A * 10/2000 Sizemore ..... 340/574

* cited by examiner

*Primary Examiner*—Jeffery Hofsass
*Assistant Examiner*—Jennifer Stone

(57) ABSTRACT

A personal alarm system for efficiently alerting individuals nearby that the user is possibly in danger. The personal alarm system includes a power source, a switch unit, and a speaker electronically connected to a control unit and positioned within an apparel member. A pin member is removably positioned within a receptacle of the switch unit with a cord member attached to the pin member. The cord member extends through an aperture within the apparel member for providing access thereto external of the apparel member. In the event of a perceived emergency, the wearer of the apparel member pulls upon the cord member thereby removing the pin member from the switch unit thereby causing the speaker to emit an audible warning sound.

14 Claims, 10 Drawing Sheets

PERSONAL ALARM SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to personal safety devices and more specifically it relates to a personal alarm system for efficiently alerting individuals nearby that the user is possibly in danger.

2. Description of the Related Art

Personal safety devices have been in use for years. An example of personal safety devices are remote controlled vehicle alarms which allow an individual to sound the vehicle's alarm system by pressing an alarm button. The main problem with vehicle alarm devices is that they do not provide protection for an individual when they are away from the vehicle.

In additional to vehicle alarm devices, compact units have been developed that an individual carries with them in a purse or other location which have a button that when pressed causes the unit to sound an alarm. The main problem with these devices is that they must be intentionally carried with the individual. Another problem with compact alarm units is that they require the user to first locate the alarm unit and then press the alarm button which can be difficult and costly in time.

While these devices may be suitable for the particular purpose to which they address, they are not as suitable for alerting individuals nearby that the user is possibly in danger. Conventional personal alarm devices either require a vehicle to be nearby or are difficult to locate in an emergency.

In these respects, the personal alarm system according to the present invention substantially departs from the conventional concepts and designs of the prior art, and in so doing provides an apparatus primarily developed for the purpose of alerting individuals nearby that the user is possibly in danger.

BRIEF SUMMARY OF THE INVENTION

In view of the foregoing disadvantages inherent in the known types of alarm devices now present in the prior art, the present invention provides a new personal alarm system construction wherein the same can be utilized for efficiently alerting individuals nearby that the user is possibly in danger.

The general purpose of the present invention, which will be described subsequently in greater detail, is to provide a new personal alarm system that has many of the advantages of the alarm devices mentioned heretofore and many novel features that result in a new personal alarm system which is not anticipated, rendered obvious, suggested, or even implied by any of the prior art alarm devices, either alone or in any combination thereof.

To attain this, the present invention generally comprises a power source, a switch unit, and a speaker electronically connected to a control unit and positioned within an apparel member. A pin member is removably positioned within a receptacle of the switch unit with a cord member attached to the pin member. The cord member extends through an aperture within the apparel member for providing access thereto external of the apparel member. In the event of a perceived emergency, the wearer of the apparel member pulls upon the cord member thereby removing the pin member from the switch unit thereby causing the speaker to emit an audible warning sound.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a personal alarm system that will overcome the shortcomings of the prior art devices.

A second object is to provide a personal alarm system for efficiently alerting individuals nearby that the user is possibly in danger.

Another object is to provide a personal alarm system that is concealed from other individuals.

An additional object is to provide a personal alarm system that is easily accessed in the event of a perceived emergency.

A further object is to provide a personal alarm system that does not significantly affect the movement of an individual.

Another object is to provide a personal alarm system that may be positioned within various types of apparel including but not limited to shirts, coats, pants and hats.

A further object is to provide a personal alarm system that sounds an audible alarm which may be heard by individuals nearby.

Another object is to provide a personal alarm system that deters individuals from following through with questionable actions.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
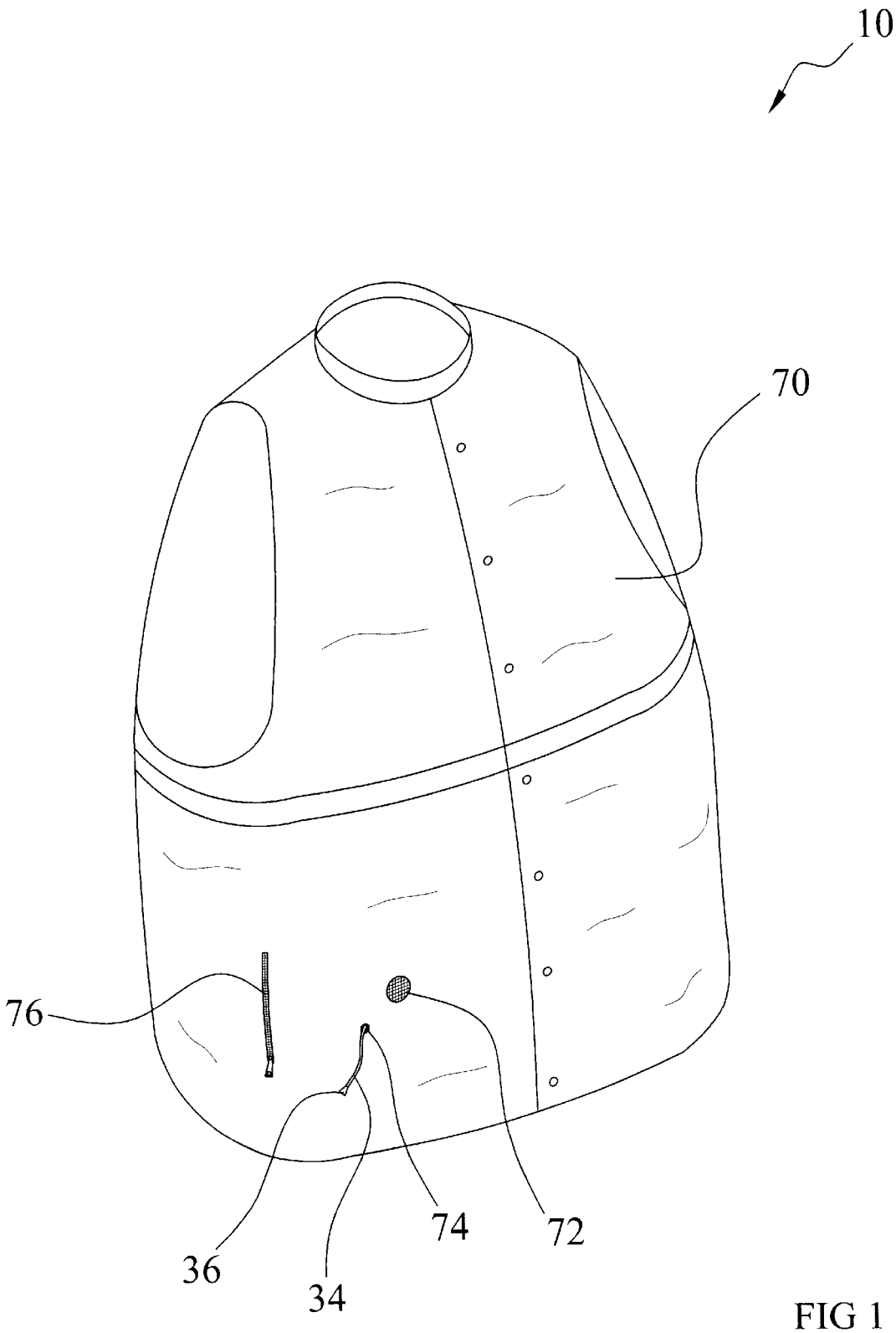
FIG. 1 is an upper perspective view of an exemplary apparel member containing the present invention.

Turning now descriptively to the drawings, in which similar reference characters denote similar elements throughout the several views, FIGS. 1 through 10 illustrate a personal alarm system 10, which comprises a power source 40, a switch unit 30, and a speaker 50 electronically connected to a control unit 20 and positioned within an apparel member 70. A pin member 32 is removably positioned within a receptacle 31 of the switch unit 30 with a cord member 34 attached to the pin member 32. The cord member 34 extends through an aperture within the apparel member 70 for providing access thereto external of the apparel member 70. In the event of a perceived emergency, the wearer of the apparel member 70 pulls upon the cord member 34 thereby removing the pin member 32 from the switch unit 30 thereby causing the speaker 50 to emit an audible warning sound.

Figure 2:
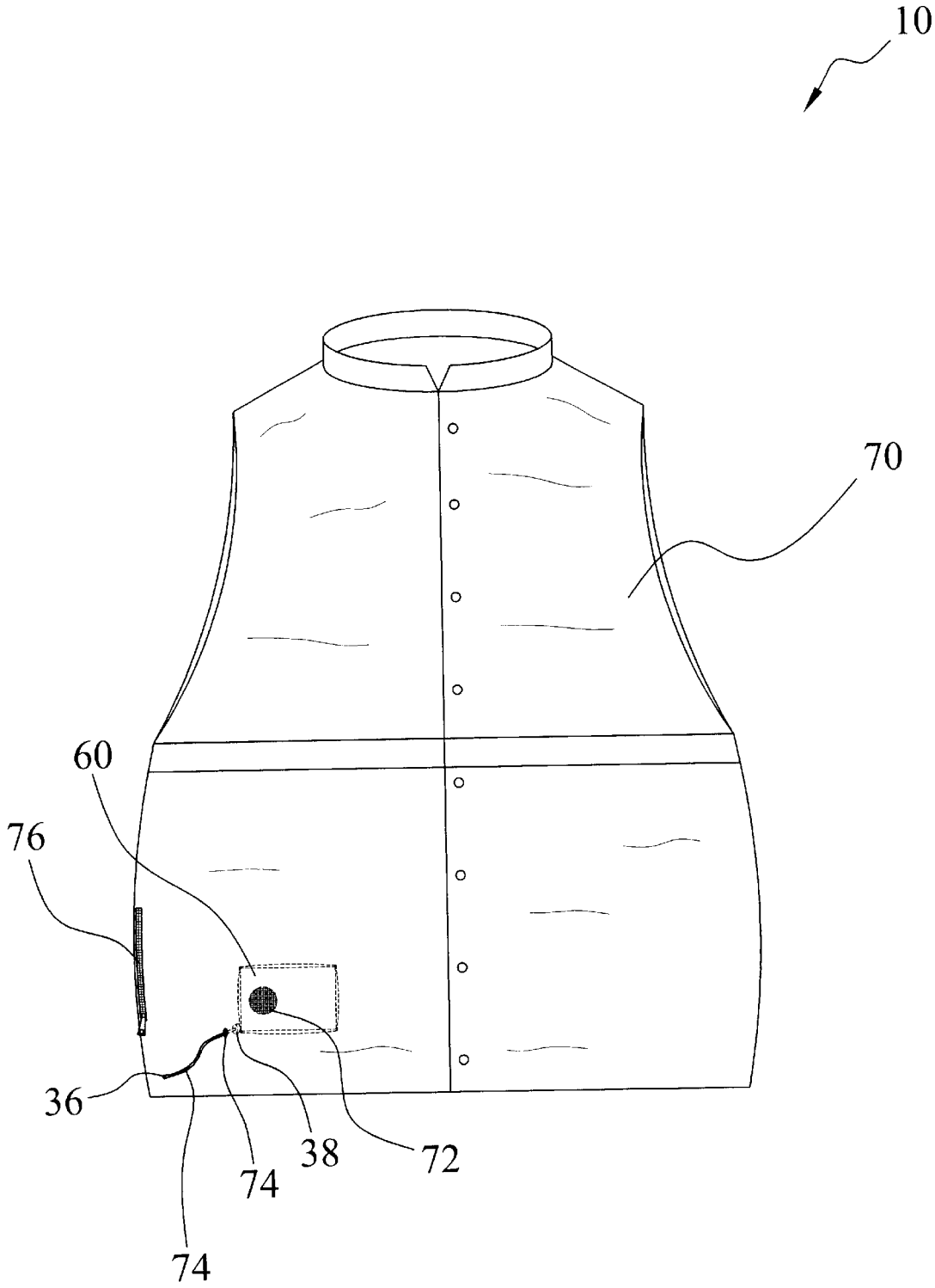
FIG. 2 is a front view of the exemplary apparel member containing the present invention.
Figure 3:
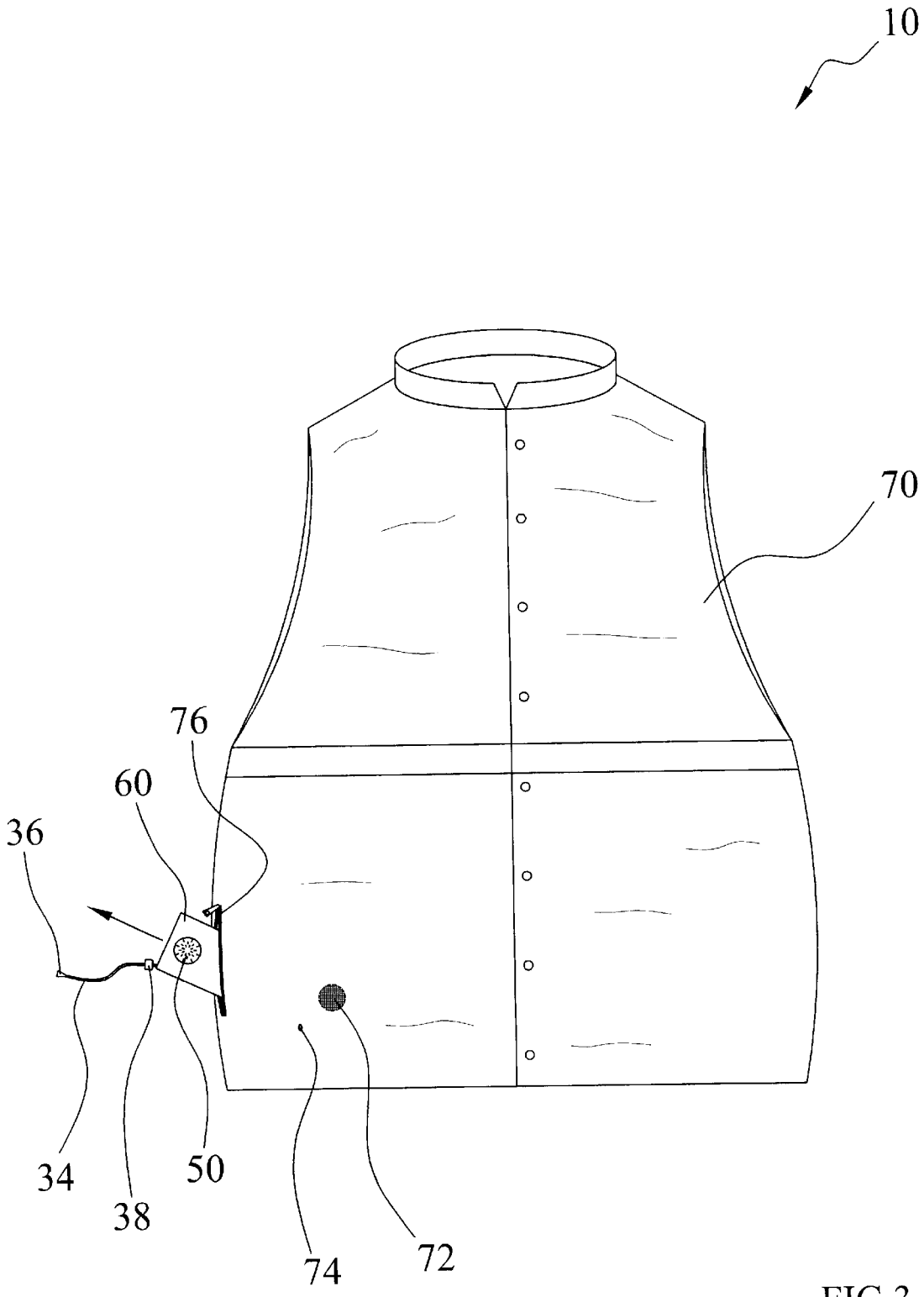
FIG. 3 is a front view of the exemplary apparel member with the present invention partially removed from thereof.
Figure 4:
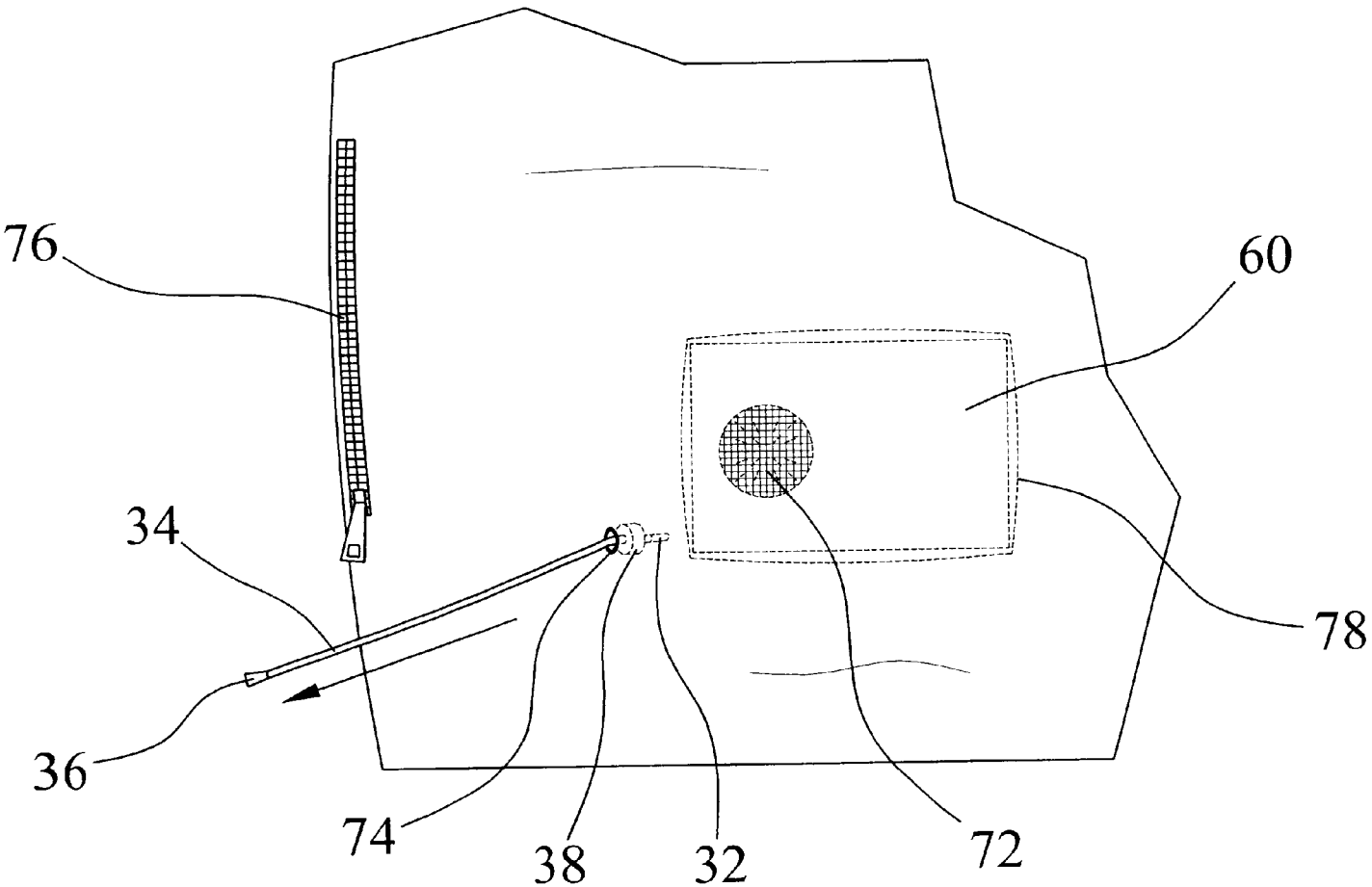
FIG. 4 is a magnified front view of the present invention within the exemplary apparel member.

An exemplary apparel member 70 is illustrated in FIGS. 1 through 3 of the drawings. It can be appreciated that the apparel member 70 may be comprised of various clothing related items such as but not limited to shirts, coats, jackets, vests, suits, dresses, skirts, shoes, hats, caps, gloves and the like. For the purposes of illustrating the usage and operation of the present invention, a vest structure will be illustrated as the apparel member 70 which should not limit the present invention.

Figure 7:
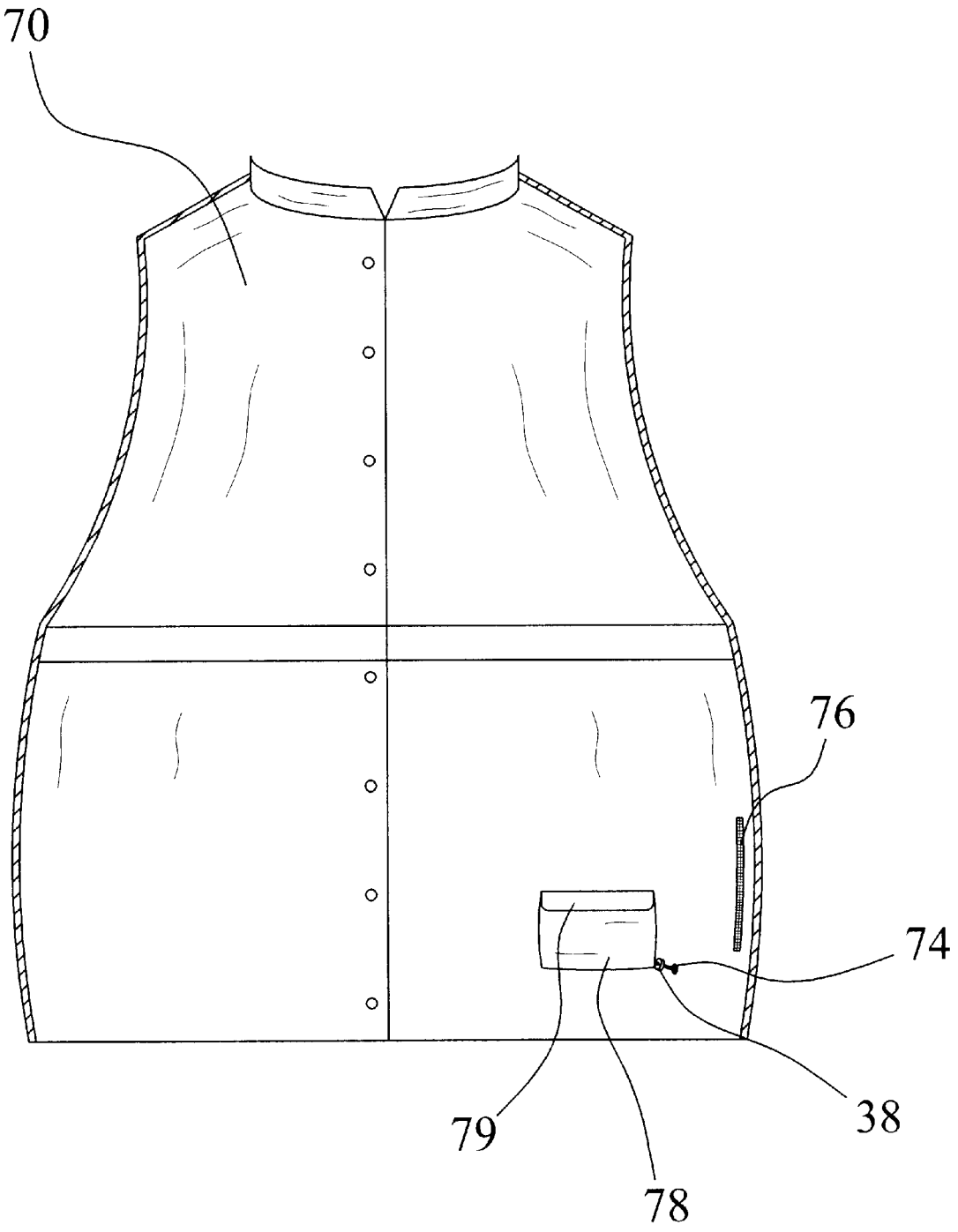
FIG. 7 is a rear cutaway view of the exemplary apparel member illustrating the pocket structure attached inside of the apparel member.
Figure 8:
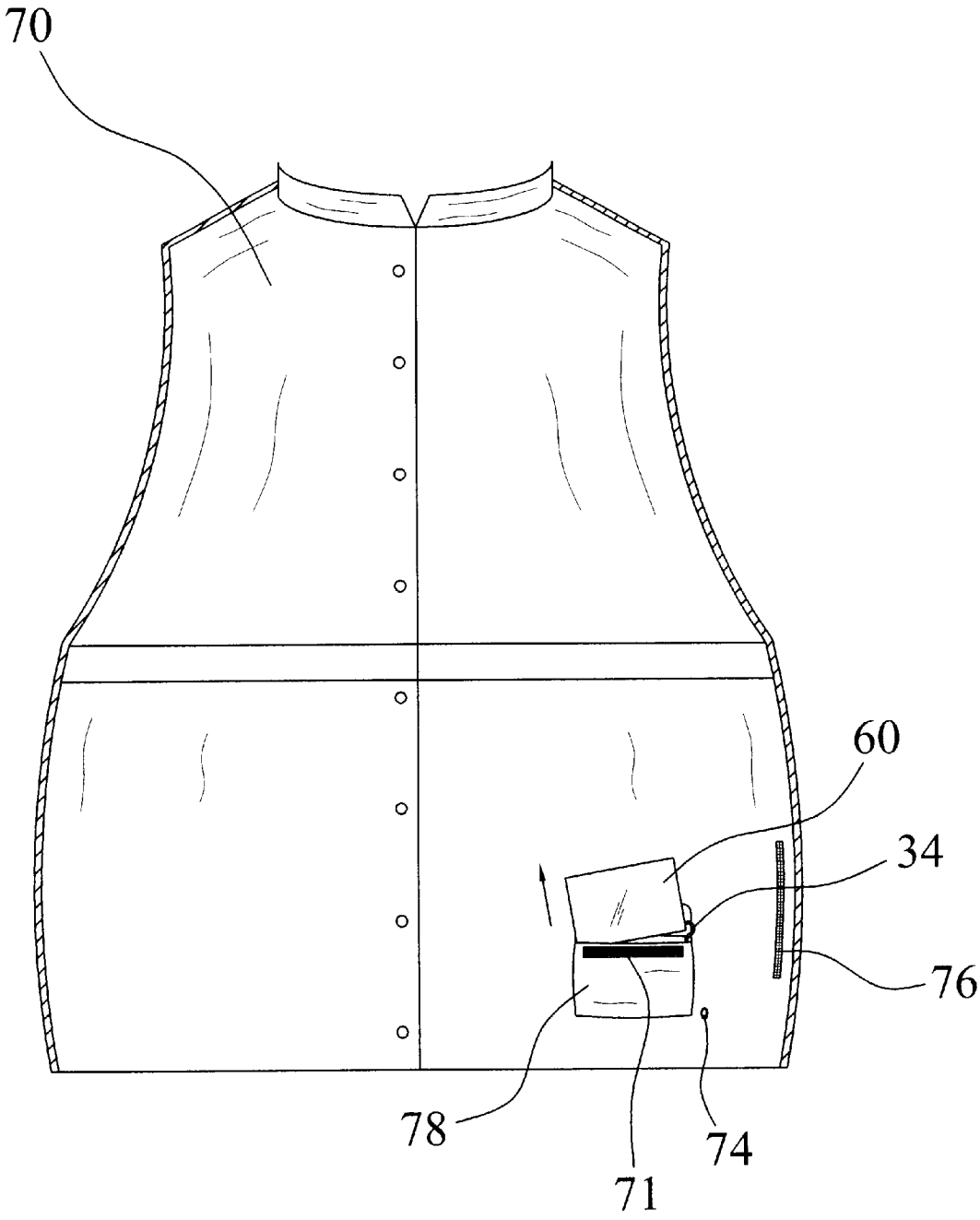
FIG. 8 is a rear cutaway view of the exemplary apparel member illustrating the present invention partially removed from the pocket structure.
Figure 9:
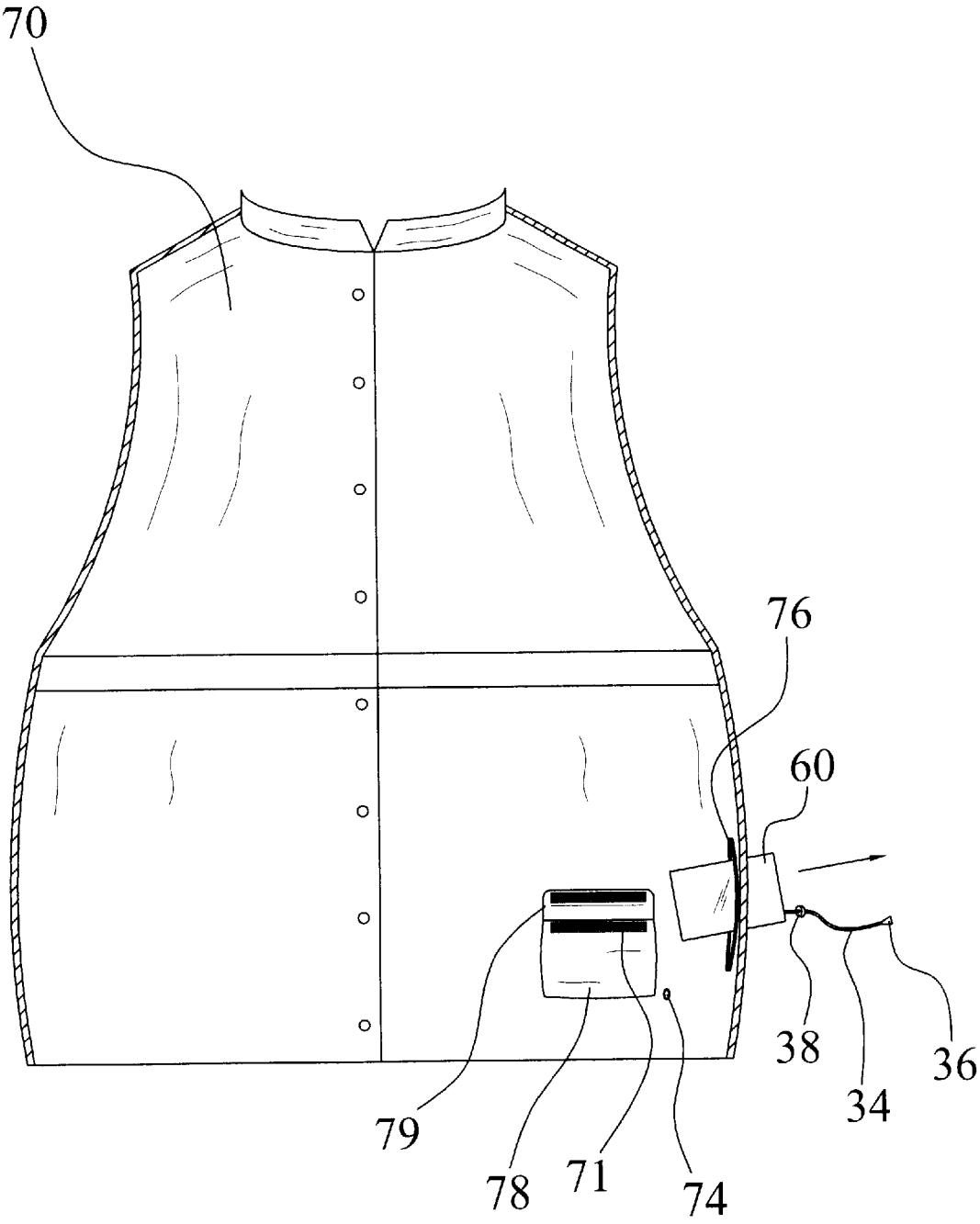
FIG. 9 is a rear cutaway view of the exemplary apparel member illustrating the present invention fully removed from the pocket structure.

As shown in FIGS. 7 through 9 of the drawings, the apparel member 70 preferably includes a pocket structure 78 within or inside of the apparel member 70 for receiving the electrical components of the present invention. The electrical components of the present invention may or may not be enclosed within a housing 60. It can be appreciated that the electrical components of the present invention may be positioned directly within the apparel member 70 without the usage of a housing 60.

The pocket structure 78 is preferably positioned in a location upon the apparel member 70 that is easy to access for the user such as but not limited to the lower front portion thereof. The pocket structure 78 preferably includes a cover member 79 secured by a fastener 71 for removably securing the electrical components within the pocket structure 78 to prevent accidental removal of the electrical components. The fastener 71 may be comprised of various types of fasteners 71 such as but not limited to snaps, buttons, and hook and loop material.

An access structure 76 is preferably positioned within the apparel member 70 in a hidden manner providing access to the pocket structure 78 from the outside of the apparel member 70. The access structure 76 may be comprised of but not limited to a hidden zipper or similar structure.

A first aperture 72 is preferably positioned within the apparel member 70 as best illustrated in FIGS. 1 through 3 of the drawings. The first aperture 72 is aligned with the speaker 50 for allowing emission of the warning sound from the speaker 50. The first aperture 72 may be partially covered by a netting or other material capable of allowing sound waves to freely travel through thereof.

Figure 10:
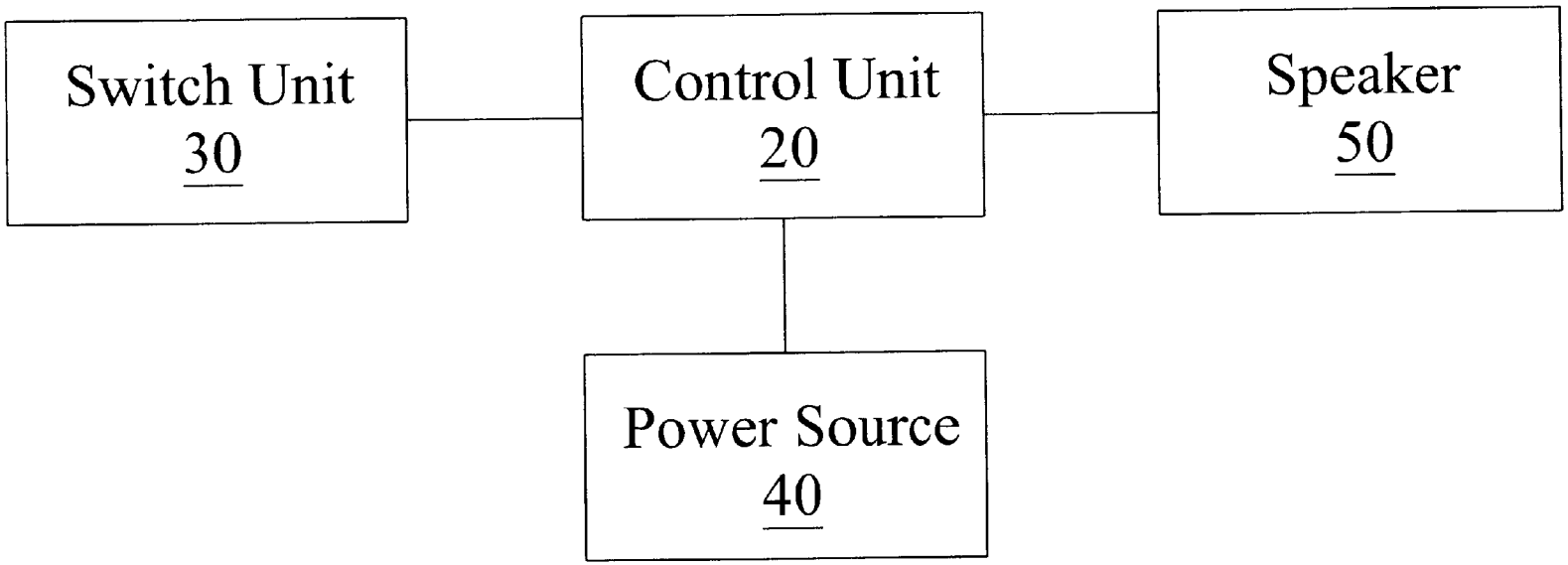
FIG. 10 is a block diagram illustrating the electrical components of the present invention.

FIG. 10 illustrates the electrical connections of the electrical components of the present invention. A control unit 20 is provided that is electrically connected to a power source 40 such as but not limited to a battery. The control unit 20 is electrically connected to a speaker 50 for emitting an audible warning sound. The warning sound may have various characteristics and levels for indicating a potential emergency situation.

A switch unit 30 is electrically connected to the control unit 20 for communicating to the control unit 20 when the user feels an emergency situation is present. The switch unit 30 has a receptacle 31 that removably receives a pin member 32. When the pin member 32 is properly positioned within the receptacle 31, no sound is emitted from the speaker 50. When the pin member 32 is removed from the receptacle 31, the warning sound is emitted from the speaker 50 until the pin member 32 is reinserted into the receptacle 31.

Figure 6:
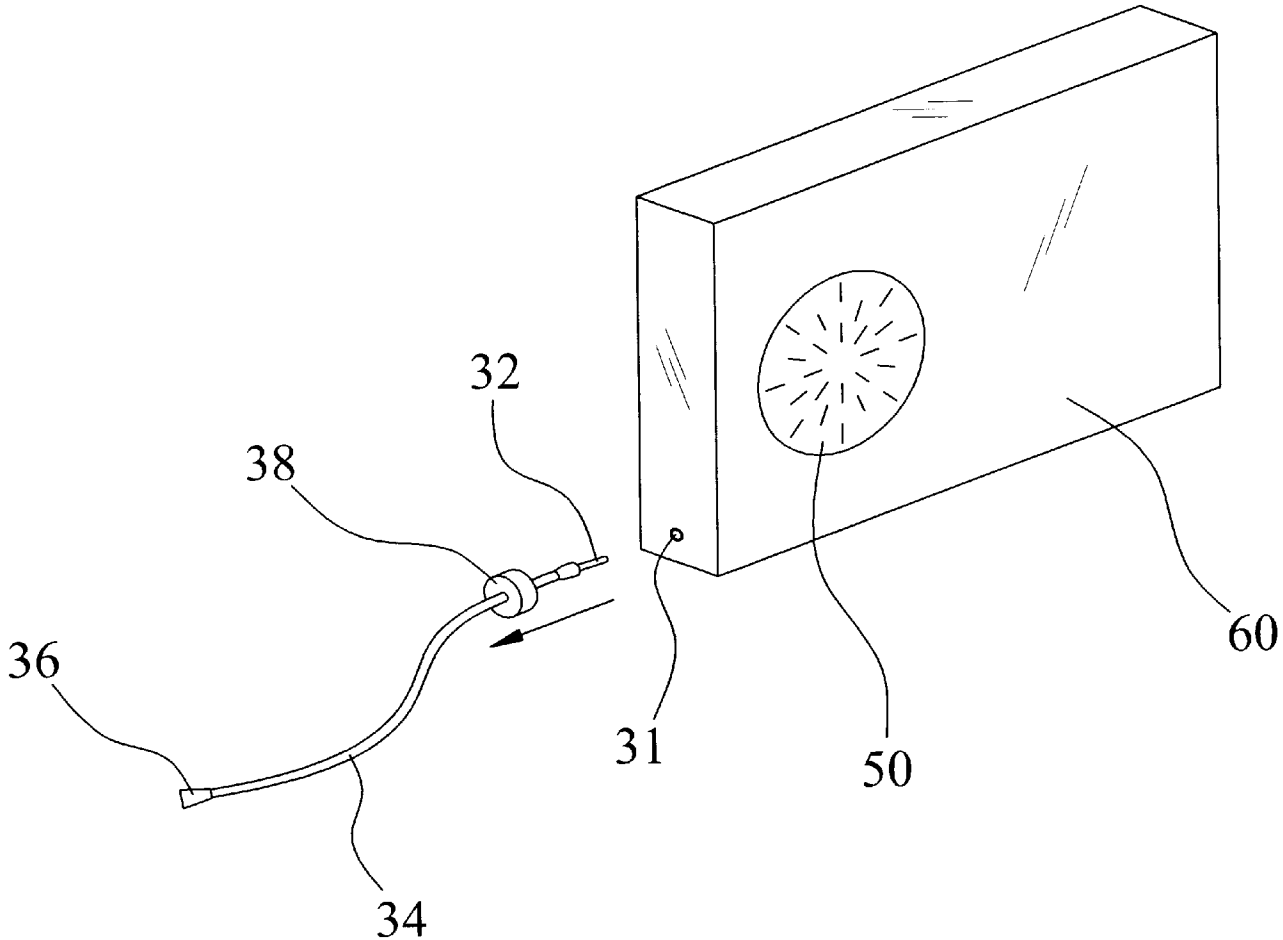
FIG. 6 is an upper perspective view of the present invention with the pin member removed from the receptacle of the switch unit.

A cord member 34 having a finite length is attached to the pin member 32 as best illustrated in FIG. 6 of the drawings. The cord member 34 may be comprised of various elongate structures having a flexible or non-flexible structure. The cord member 34 preferably extends through an opening within the pocket structure 78 through a second aperture 74 within the apparel member 70 thereby allowing the individual to grasp and pull upon the cord member 34 external of the apparel member 70. The cord member 34 may extend directly through the second aperture 74 within the apparel member 70 instead of passing through the pocket structure 78.

A gripping member 36 is preferably attached to the distal end of the cord member 34 for facilitating grasping of the cord member 34. A stopper member 38 is preferably attached about the cord member 34 between the second aperture 74 and the pin member 32 for preventing complete removal of the cord member 34 from the apparel member 70 if the pin member 32 is removed from the receptacle 31. The stopper member 38 has a size greater than the second aperture 74 for preventing the stopper member 38 from extending through the second aperture 74.

Figure 5:
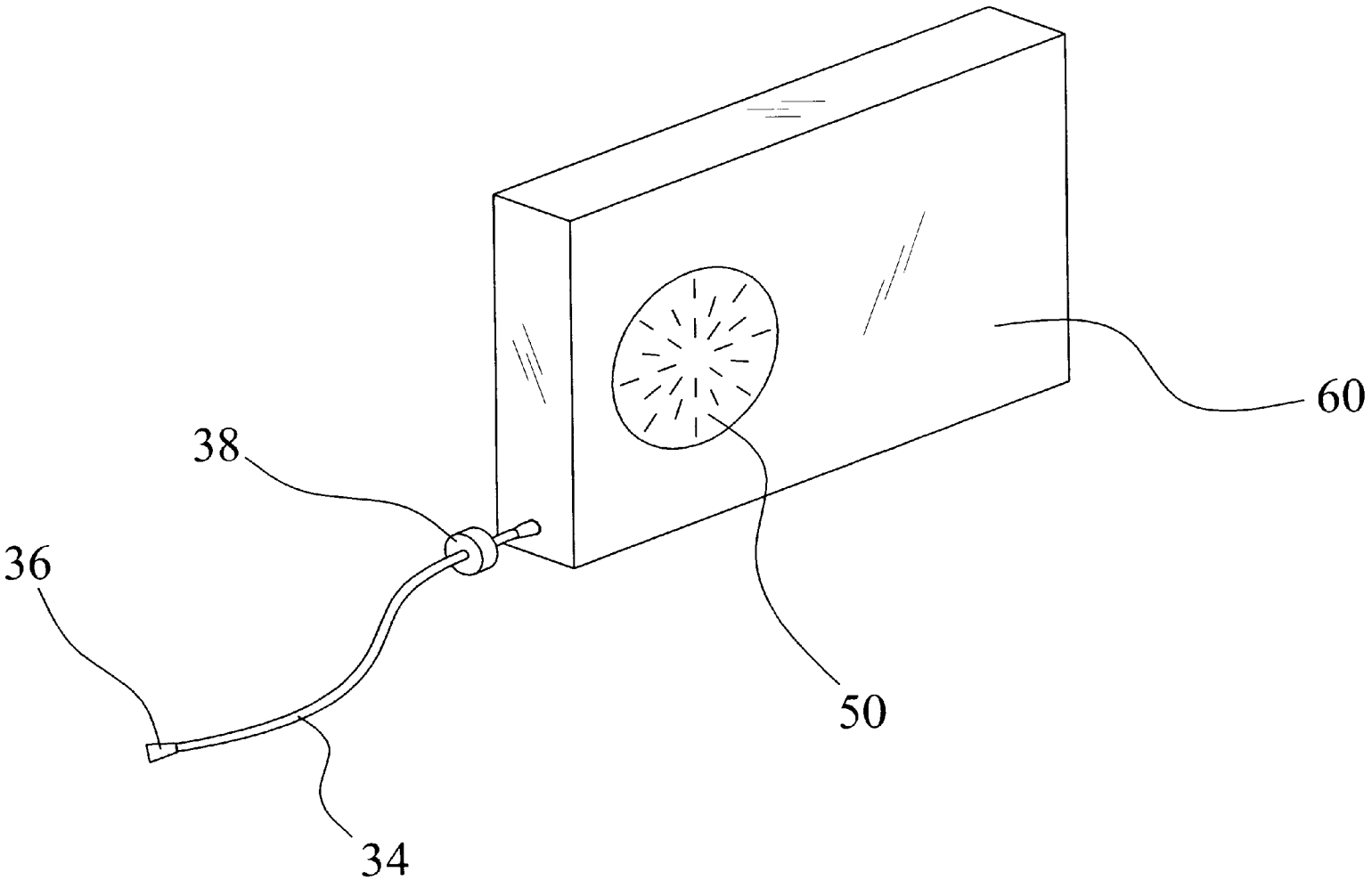
FIG. 5 is an upper perspective view of the present invention.

A housing 60 may be used to protect the electrical components as shown in FIGS. 5 and 6 of the drawings. The housing 60 is preferably a compact structure and may have various shapes and structures. The housing 60 is preferably comprised of a rigid protective structure, however non-rigid and semi-rigid structures may be utilized to construct the housing 60.

In use, the user wears the apparel member 70 as conventional apparel. If the user feels that a potential emergency exists, the user then pulls upon the cord member 34 extending from the apparel member 70 thereby removing the pin member 32 from the receptacle 31 of the switch unit 30. The control unit 20 thereafter emits an audible warning sound through the speaker 50. The warning sound continues until the pin member 32 is reinserted into the receptacle 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A personal alarm system for usage within an apparel member, comprising:

a control unit;

a speaker in communication with said control unit;

a switch unit in communication with said control unit;

a receptacle within said switch unit;

a pin member removably positioned within said receptacle, wherein if said pin member is removed from said receptacle said speaker emits a warning sound; and a cord member attached to said pin member, wherein said cord member extends through a second aperture within said apparel member; and a stopper member attached to said cord member near said pin member for preventing removal of said cord member through said second aperture.

2. The personal alarm system of claim 1, wherein said apparel member includes a second aperture aligned with said speaker.

3. The personal alarm system of claim 2, wherein said second aperture includes a netting.

4. The personal alarm system of claim 1 wherein said stopper member has a size larger than said first aperture.

5. The personal alarm system of claim 1, including a gripping member attached to a distal end of said cord member.

6. The personal alarm system of claim 1, wherein if said pin member is inserted within said receptacle after said warning sound is emitted, said warning sound is terminated.

7. The personal alarm system of claim 1, wherein said apparel member includes an access structure.

8. A personal alarm system for usage within an apparel member, comprising:

a control unit;

a speaker in communication with said control unit;

a switch unit in communication with said control unit;

a receptacle within said switch unit;

a housing surrounding said control unit, said speaker, said switch unit and said receptacle;

a pin member removably positioned within said receptacle, wherein if said pin member is removed from said receptacle said speaker emits a warning sound; and a cord member attached to said pin member, wherein said cord member extends through a second aperture within said apparel member; and a stopper member attached to said cord member near said pin member for preventing removal of said cord member through said second aperture.

9. The personal alarm system of claim 8, wherein said apparel member includes a second aperture aligned with said speaker.

10. The personal alarm system of claim 9, wherein said second aperture includes a netting.

11. The personal alarm system of claim 8, wherein said stopper member has a size larger than said first aperture.

12. The personal alarm system of claim 8, including a gripping member attached to a distal end of said cord member.

13. The personal alarm system of claim 8, wherein if said pin member is inserted within said receptacle after said warning sound is emitted, said warning sound is terminated.

14. The personal alarm system of claim 8, wherein said apparel member includes a pocket structure for receiving said housing.

* * * * *